US006309105B1

(12) United States Patent
Palumbo

(10) Patent No.: US 6,309,105 B1
(45) Date of Patent: Oct. 30, 2001

(54) RESEALABLE PACK

(75) Inventor: Gianfranco Palumbo, Bad Homburg (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/817,312

(22) PCT Filed: Oct. 5, 1995

(86) PCT No.: PCT/US95/13027

§ 371 Date: Jun. 25, 1997

§ 102(e) Date: Jun. 25, 1997

(87) PCT Pub. No.: WO96/11147

PCT Pub. Date: Apr. 18, 1996

(30) Foreign Application Priority Data

Oct. 7, 1994 (IT) ..... TO9400795

(51) Int. Cl.[7] ..... B65D 33/00

(52) U.S. Cl. ..... 383/211; 206/494; 206/812; 383/203; 383/208; 383/210; 383/66

(58) Field of Search ..... 383/203, 210, 383/211, 66, 207–209; 229/206, 238, 87.05; 206/494, 812

(56) References Cited

U.S. PATENT DOCUMENTS

| | | | | |
|---|---|---|---|---|
| 2,499,528 | * | 3/1950 | Reitzes | 383/209 X |
| 2,541,674 | * | 2/1951 | Snyder | 383/209 |
| 2,896,839 | * | 7/1959 | Barnes et al. | 383/211 |
| 3,343,541 | * | 9/1967 | Bellamy, Jr. | 383/210 X |
| 3,397,835 | * | 8/1968 | Henning | 383/209 |
| 3,510,054 | * | 5/1970 | Sanni et al. | 383/209 |
| 4,101,026 | | 7/1978 | Bonk . | |
| 4,192,420 | * | 3/1980 | Worrell, Sr. et al. | 383/207 X |
| 4,260,061 | * | 4/1981 | Jacobs | 383/211 X |
| 4,420,080 | | 12/1983 | Nakamura . | |
| 4,462,507 | | 7/1984 | Margulies . | |
| 4,552,269 | | 11/1985 | Chang . | |
| 4,648,510 | * | 3/1987 | Kuenzel | 206/494 |
| 4,651,874 | | 3/1987 | Nakamura . | |
| 4,679,693 | * | 7/1987 | Forman | 383/211 X |
| 4,723,301 | | 2/1988 | Chang . | |
| 4,840,270 | * | 6/1989 | Caputo et al. | 383/66 X |
| 4,848,575 | | 7/1989 | Nakamura et al. . | |
| 5,165,545 | * | 11/1992 | Focke et al. | 383/203 X |
| 5,295,579 | * | 3/1994 | Focke et al. | 206/494 |
| 5,531,325 | | 7/1996 | Deflander et al. . | |

FOREIGN PATENT DOCUMENTS

| | | | | |
|---|---|---|---|---|
| 275561 | * | 2/1966 | (AU) | 383/208 |
| 4134567 | * | 1/1993 | (DE) | 229/87.05 |
| 4202258 | * | 7/1993 | (DE) | 383/207 |
| 1090427 | * | 3/1955 | (FR) | 229/87.05 |
| 83/00677 | * | 3/1983 | (WO) | 229/206 |

* cited by examiner

*Primary Examiner*—Stephen K. Cronin
*Assistant Examiner*—Robin A. Hylton
(74) *Attorney, Agent, or Firm*—Gerry S. Gressel; Larry L. Huston; Roddy M. Bullock

(57) ABSTRACT

A pack has a body (11) defining a cavity for receiving articles such as wet wipes. The body (11) is provided with a slit (13) which is non-rectilinear and which has first and second ends, for example V-shaped. A sealing member (15) covers the slit and is resealably adhered to the body on both sides of the slit, whereby to provide a seal.

11 Claims, 1 Drawing Sheet

RESEALABLE PACK

This invention relates to a resealable pack. It is particularly intended for use in the packaging of wet wipes, but it is to be understood that the invention is also applicable to the packaging of other articles.

As is well known, wet wipes are articles in the form of small sheets which are impregnated with a skin-cleansing liquid and which are intended to be disposed of after a single use. Wet wipes are sometimes packaged individually, in which case the packaging is thrown away after it has been opened and the wet wipe removed therefrom. However it is also known to produce a pack containing a plurality of wet wipes. In that case, the pack must be provided with a resealable opening, since the skin-cleansing liquid with which the wipes are impregnated evaporates readily, and the wipes will therefore dry out unless the pack can be properly resealed after each wipe is removed.

In conventional wet wipes packs, the tape used for sealing and resealing the opening represents a substantial portion of the cost of the product. Furthermore, to prevent the cost of the tape becoming excessive it is usual to provide only a relatively small opening in the pack, so that the amount of tape required is reduced, and this makes it difficult for a user to remove wet wipes from the pack and may even result in their breaking during the course of removal. It is an object of the present invention to provide a pack in which the amount of material required to effect resealing is reduced in relation to the size of opening with which the pack is provided. By virtue of this it is feasible to increase the size of the opening, or reduce the cost of the material required for sealing, or both.

According to the present invention there is provided a pack having a body portion defining an article-receiving cavity, the body portion being provided with a slit which is non-rectilinear and which has first and second ends; and a sealing member which covers the slit and is resealably adhered to the body portion on both sides of the slit, whereby to provide a seal, the sealing member having a pair of side edges, one on either side of the slit, both of which side edges follow generally the direction of the slit.

It is to be understood that the term "slit" does not necessarily imply that the material concerned begins in non-slitted form and then has a slit formed therein by a slitting process, though that would normally be the case. Further, it is to be understood that the term "slit" is intended to encompass not only openings which have a zero or very small width, and which would normally be described as slits, but also openings having a significant width, for example up to several mm, or even more, and which might more usually be described as slots.

Preferably, the said side edges are substantially parallel to one another and to the direction of the slit. In a preferred embodiment of the invention the slit is generally V-shaped, and the sealing member is correspondingly generally V-shaped. The apex angle of the "V" is preferably from 40° and 100°, most preferably about 50°. However, other shapes of slit and tab may be used instead. Thus, in an alternative embodiment the slit can be curved, for example arcuate, and may, for example, semicircular, and the sealing member may be correspondingly shaped.

As will become apparent from the following description of the embodiment illustrated in the accompanying drawings, the pack of the present invention is more economical than conventional resealable packs in terms of the amount of material required for the sealing member. The invention will now be further described with reference to the accompanying drawings, in which.

Figure 1:
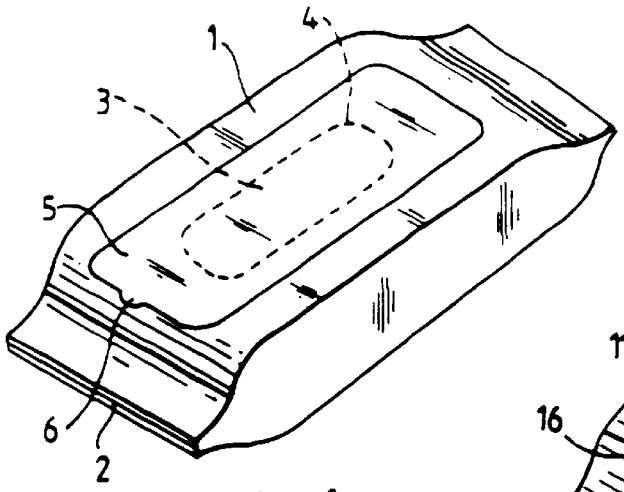
Fig.1. Prior Art
FIG. 1 is a diagrammatic perspective view of a known pack for wet wipes, the pack being in its sealed condition.

The known wet wipes pack shown in FIG. 1 comprises a body 1 of generally parallelepiped form formed of a plastics material, for example a polyethylene film, a polypropylene film or a laminate consisting of, for example, polyethylene and polypropylene layers, optionally with a layer of paper between them. The body is formed of a single sheet of plastics material sealed at its opposite ends by end seams 2, and also having a longitudinal seam on the reverse side (not visible in FIG. 1). An elongate opening 3 is defined in the top face of the body portion. The opening is of generally rectangular form, but the ends 4 thereof are rounded so as to avoid forming sharp corners which might be unhelpful as regards the removal of articles from within the body.

The opening 3 is covered by a sealing member 5 which is resealably secured to the adjacent face of the body 1 by means of an adhesive, for example an acrylic-based or rubber-based adhesive. Sealing is provided over the whole of the area where the sealing member 5 overlies the body 1, except for a tab 6 at one end of the sealing member 5. This provides a location where the user can grasp the sealing member. It will be seen that even for quite a small opening 3 it is necessary to provide a comparatively large sealing member 5, since the latter must extend beyond the former on all sides if it is to provide the requisite seal. The material of the sealing member 5, i.e. the substrate to which the adhesive is applied, may, for example, be a polypropylene film, or a laminate of paper/polypropylene, paper/polyethylene, or polyethylene/polypropylene. Where a two-layer laminate is used which includes paper, the adhesive is advantageously applied to the paper.

Wet wipes or other articles are held within the cavity defined by the body 1. When a user desires to remove a wet wipe, he grasps the tab 6 and pulls the sealing member away from the adjacent face of the body portion 1 so as to expose the aperture 3, and then removes a wet wipe through the aperture. Means (not shown) may be provided to prevent the sealing member 5 from being completely removed from the body 1, so that it remains attached to it at all times at the end of the sealing member remote from the tab 6. After the user has removed a wet wipe he then brings the sealing member back to the position shown in FIG. 1 so as to reseal the opening 3.

Figure 2:
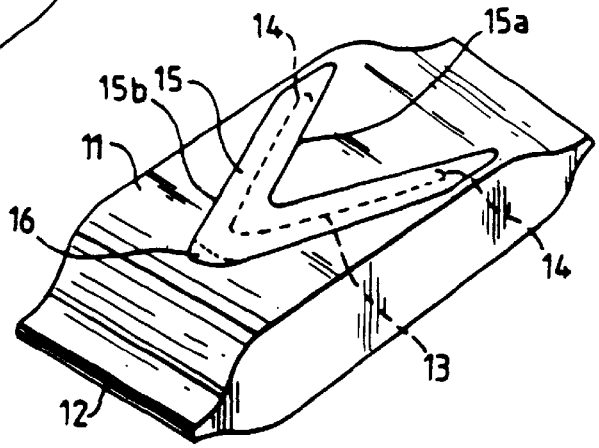
FIG. 2 is a similar view of a pack according to the present invention.

An embodiment of the invention is shown in its closed position in FIG. 2. As in the case of the known pack shown in FIG. 1, this comprises a body, here denoted by reference numeral 11, which is sealed by end seals 12 and a longitudinal seal (not shown). In this case, however, instead of the aperture 3 there is a generally V-shaped slit 13. This has first and second ends 14 which, as shown in FIG. 2, are arcuate (for example semicircular) with the open sides of the arcs facing back towards the apex of the V.

A generally V-shaped sealing member 15 covers the whole of the length of the slit 13 and is resealably connected by an adhesive to the body 11 on both sides of the slit. Thus, in the position shown in FIG. 2 the slit is completely sealed by the sealing member 15. The latter is adhered to the body 11 over substantially the whole of its surface, except that a tab 16 is provided at the apex of the V, where the sealing member 15 is not adhered to the body. This serves the same purpose as the tab 6 in FIG. 1. The sealing member 15 has side edges 15*a* and 15*b* which at least follow generally the direction of the slit 13, and are preferably substantially parallel to one another and to the slit.

When the user desires to remove a wet wipe from the pack he grasps the tab 16 and uses it to pull the sealing member 15 upwardly, starting at the apex of the V. The effect of this is that the portion of the sealing member 15 on the outside of the V is pulled away from that part of the body 11 to which it was previously adhered, but the portion of the sealing member on the inside of the V remains adhered to the body. The arcuate portions 14 are provided as a precaution to reduce the risk that continued pulling on the tab beyond the stage indicated in FIG. 3 will cause the material of the body 11 to tear. In practice, however, the risk of this is slight and the arcuate portions 14 can generally be omitted.

Figure 3:
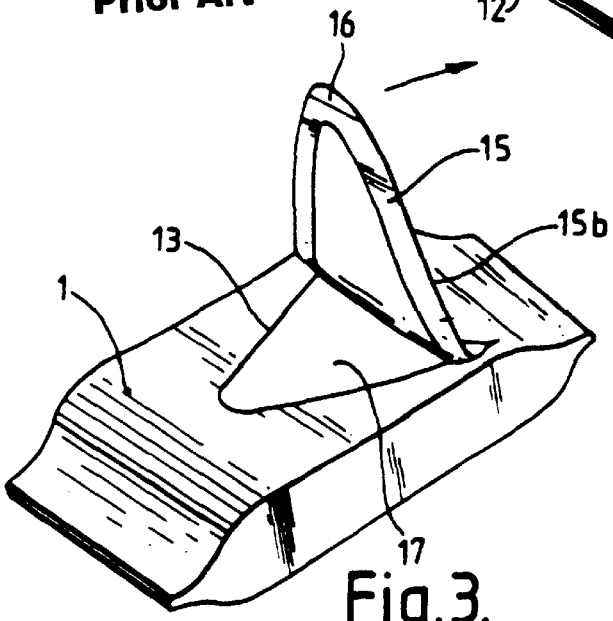
FIG. 3 shows the pack of FIG. 2 in its opened condition.

As can be seen in FIG. 3, the opening process just described exposes a large V-shaped opening 17 through which a wet wipe can easily be withdrawn. After this has been done the sealing member 15 is lowered to the position shown in FIG. 2 and the pack is resealed.

Figure 4:
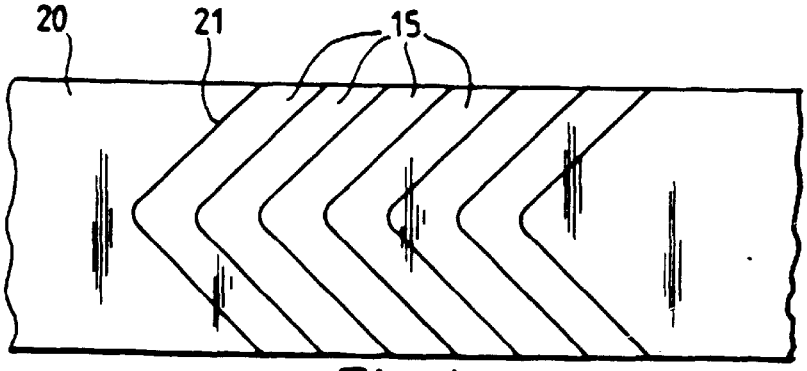
FIG. 4 shows part of a strip of material for use in the manufacture of the sealing members, showing how a plurality of the members can be cut therefrom.

In relation to the size of opening which it provides, the sealing member 15 can be formed of relatively little material. This is illustrated in FIG. 4, which shows a strip 20 of material suitable for forming sealing members 15. This can be used to provide a plurality of sealing members 15 by severing it along the V-shaped lines 21. This means that there is no wastage of material at all, except at the very ends of the strip 20, and that wastage can be made insignificant by using a sufficiently long strip. It is not necessary to trim the sealing members 15 in any way. This contrasts with sealing members of the type indicated by reference numeral 5 in FIG. 1, where the sealing member is large in relation to the opening available for removal of a wet wipe, and where, furthermore, the shape of the sealing member is such that wastage of the sheet from which it is cut is inevitable.

Preferably, the tape is coated with adhesive before the tape is severed into individual sealing members, leaving adhesive-free zones to form the tabs 16.

As already mentioned, the sealing member used in the invention can have a shape other than V-shaped, and one possibility is to use a member which is. arcuate, for example semicircular.

I claim:

1. A pack having a body portion defining an article-receiving cavity, the body portion being provided with a slit having up to a very small width, said slit being non-rectilinear and having first and second ends; and a sealing member which covers the slit and is resealably adhered to the body portion on both sides of the slit, the sealing member having a pair of side edges, one on either side of the slit, both of which side edges substantially follow the direction of the slit.

2. A pack according to claim 1, wherein the body portion is made of a flexible sheet plastics material.

3. A pack according to claim 1, wherein the sealing member is made of a flexible sheet plastics material.

4. A pack according to claim 1, wherein the sealing member has a first end at which it is provided with a tab which is not sealed to the body portion and which is grasped by a user.

5. A pack according to claim 1, wherein the slit is substantially V-shaped.

6. A pack according to claim 5, wherein the apex angle of the "V" is from 40° to 100°.

7. A pack according to claim 6, wherein the said angle is about 50°.

8. A pack according to claim 1, wherein the said side edges are substantially parallel to one another.

9. A pack according to claim 8, wherein the said side edges are substantially parallel to the direction of the slit.

10. A pack according to claim 1, wherein the article-receiving cavity contains a plurality of wet wipes.

11. A pack according to claim 1, wherein said slit has substantially zero width.

* * * * *